US009932797B2

(12) United States Patent
Themig et al.

(10) Patent No.: US 9,932,797 B2
(45) **Date of Patent: *Apr. 3, 2018**

(54) PLUG RETAINER AND METHOD FOR WELLBORE FLUID TREATMENT

(71) Applicant: PACKERS PLUS ENERGY SERVICES INC., Calgary (CA)

(72) Inventors: Daniel Jon Themig, Calgary (CA); James Fehr, Sherwood Park (CA); Michael Kenyon, Calgary (CA)

( * ) Notice: Subject to any disclaimer, the term of this patent is extended or adjusted under 35 U.S.C. 154(b) by 139 days.

This patent is subject to a terminal disclaimer.

(21) Appl. No.: 14/838,817

(22) Filed: Aug. 28, 2015

(65) Prior Publication Data

US 2015/0369010 A1 Dec. 24, 2015

Related U.S. Application Data

(63) Continuation of application No. 13/499,774, filed as application No. PCT/CA2010/001728 on Oct. 29, 2010, now Pat. No. 9,151,148.

(60) Provisional application No. 61/256,944, filed on Oct. 30, 2009, provisional application No. 61/288,714, filed on Dec. 21, 2009, provisional application No. 61/326,776, filed on Apr. 22, 2010.

(51) Int. Cl.

| | |
|---|---|
| ***E21B 34/14*** | (2006.01) |
| ***E21B 43/30*** | (2006.01) |
| ***E21B 33/12*** | (2006.01) |
| ***E21B 34/10*** | (2006.01) |
| ***E21B 34/12*** | (2006.01) |
| ***E21B 41/00*** | (2006.01) |
| ***E21B 43/16*** | (2006.01) |
| *E21B 34/00* | (2006.01) |

(52) U.S. Cl.

CPC ..... *E21B 34/14* (2013.01); *E21B 33/12* (2013.01); *E21B 34/10* (2013.01); *E21B 34/12* (2013.01); *E21B 41/00* (2013.01); *E21B 43/16* (2013.01); *E21B 43/305* (2013.01); *E21B 2034/007* (2013.01)

(58) Field of Classification Search

CPC ..... E21B 34/12; E21B 33/12; E21B 41/00; E21B 43/16; E21B 34/10; E21B 34/14; E21B 43/305; E21B 2034/007

See application file for complete search history.

(56) References Cited

U.S. PATENT DOCUMENTS

| | | | |
|---|---|---|---|
| 2,212,087 | A | 8/1940 | Thornhill |
| 4,343,357 | A | 8/1982 | Yeates |
| 5,146,992 | A | 9/1992 | Baugh |

(Continued)

*Primary Examiner* — Brad Harcourt

(57) ABSTRACT

A method for fluid treatment of a borehole including a main wellbore, a first wellbore leg extending from the main wellbore and a second wellbore leg extending from the main wellbore, the method includes: running a wellbore tubing string apparatus into the first wellbore leg; conveying a plug into the wellbore tubing string apparatus to actuate a plug-actuated sleeve in the wellbore tubing string apparatus to open a port through the wall of the wellbore tubing string apparatus covered by the sleeve; employing a plug retainer to retain the plug in the tubing string against passing outwardly from the tubing string apparatus; allowing fluids to flow toward surface outwardly from the tubing string apparatus; and performing operations in the second wellbore leg.

17 Claims, 16 Drawing Sheets

(56) References Cited

U.S. PATENT DOCUMENTS

| | | | |
|---|---|---|---|
| 6,467,546 | B2 | 10/2002 | Allamon et al. |
| 6,547,007 | B2 | 4/2003 | Szarka et al. |
| 6,571,880 | B1 | 6/2003 | Butterfield, Jr. et al. |
| 6,725,935 | B2 | 4/2004 | Szarka et al. |
| 6,866,100 | B2 | 3/2005 | Gudmestad et al. |
| 6,907,936 | B2 | 6/2005 | Fehr et al. |
| 6,920,930 | B2 | 7/2005 | Allamon et al. |
| 7,108,067 | B2 | 9/2006 | Themig et al. |
| 7,503,392 | B2 | 3/2009 | King et al. |
| 7,533,728 | B2 | 5/2009 | Winslow et al. |
| 7,673,677 | B2 | 3/2010 | King et al. |
| 7,735,549 | B1 | 6/2010 | Nish et al. |
| 9,151,148 | B2 * | 10/2015 | Themig ..... E21B 34/14 |
| 2004/0163820 | A1 | 8/2004 | Bishop et al. |
| 2007/0107901 | A1 | 5/2007 | Maguire |
| 2008/0314596 | A1 | 12/2008 | Themig |

* cited by examiner

PLUG RETAINER AND METHOD FOR WELLBORE FLUID TREATMENT

PRIORITY APPLICATIONS

This application claims priority to U.S. provisional application Ser. No. 61/256,944, filed Oct. 30, 2009, U.S. provisional application Ser. No. 61/288,714, filed Dec. 21, 2009 and U.S. provisional application Ser. No. 61/326,776, filed Apr. 22, 2010.

FIELD OF THE INVENTION

The invention relates to a method and apparatus for wellbore fluid treatment and, in particular, to a multi-leg wellbore fluid treatment apparatus and a method for fluid treatment of a wellbore using and managing actuator plugs.

BACKGROUND OF THE INVENTION

Actuator plugs are used for downhole tool actuation. Generally, actuator plugs are conveyed downhole to land on the tool and actuate it. Actuator plugs can take various forms such as balls, darts, etc. Actuator plugs can be conveyed by gravity and/or fluid flow. In this application, the terms "plug" and "ball" are used interchangeably.

Recently, as described in U.S. Pat. Nos. 6,907,936 and 7,108,067 to Packers Plus Energy Services Inc., the assignee of the present application, wellbore treatment apparatus have been developed that include a wellbore treatment string including one or more openable port mechanisms that allow selected access to one or more zones in a well. The port mechanism employed includes a port through the string wall and a sleeve thereover with a sealable seat formed in the inner diameter of the sleeve. The sleeve may be moved to open or close the port by launching a plug, which can land in and seal against the seat and thereby create a pressure differential to drive the sleeve through the tubing string, such driving acts to open or close the port over which the sleeve is positioned. If more than one openable port mechanism is employed, a plurality of plugs can be used and/or one plug can actuate more than one sleeve. In one multi-sleeve system, the seat in each sleeve can be formed to accept a plug of a selected diameter but to allow plugs of lesser diameters to pass.

Once the pressure differential is dissipated, the plug may tend to lift off the seat and in fact may, by flow of fluids upwardly in the well, begin to move toward surface. If the wellbore treatment apparatus is used in a multi-leg well, the movement of plugs out of the apparatus and/or out of the wellbore leg in which they were employed may interfere with wellbore operations in other parts of the well.

SUMMARY OF THE INVENTION

In one embodiment, there is provided a method for fluid treatment of a borehole including a main wellbore, a first wellbore leg extending from the main wellbore and a second wellbore leg extending from the main wellbore, the method including: running a wellbore tubing string apparatus into the first wellbore leg; conveying a plug into the wellbore tubing string apparatus to actuate a plug-actuated sleeve in the wellbore tubing string apparatus to open a port through the wall of the wellbore tubing string apparatus covered by the sleeve; employing a plug retainer to retain the plug in the tubing string against passing outwardly from the tubing string apparatus; allowing fluids to flow toward surface outwardly from the tubing string apparatus; and performing operations in the second wellbore leg.

In another embodiment, there is also provided a wellbore installation for the a well including a main wellbore, a first wellbore leg extending from the main wellbore and a second wellbore leg extending from the main wellbore, the wellbore installation comprising: a tubing string in the first wellbore leg, the tubing string including: an upper end; and a inner bore accessible through the upper end; a sleeve in the inner bore, the sleeve having an inner diameter and a valve seat on the inner diameter such that the sleeve is moveable along the inner bore from a first position to a second position by introducing a plug through the upper end, landing the plug on the valve seat and creating a pressure differential across the plug and valve seat; and a plug retainer to prevent movement of the plug outwardly from the tubing string upper end without sealing fluid flow upwardly out of the upper end, the plug retainer positioned between the valve seat and the upper end; and an apparatus in the second wellbore leg, the apparatus including: a plug-actuated tool.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF VARIOUS EMBODIMENTS

Figure 1:
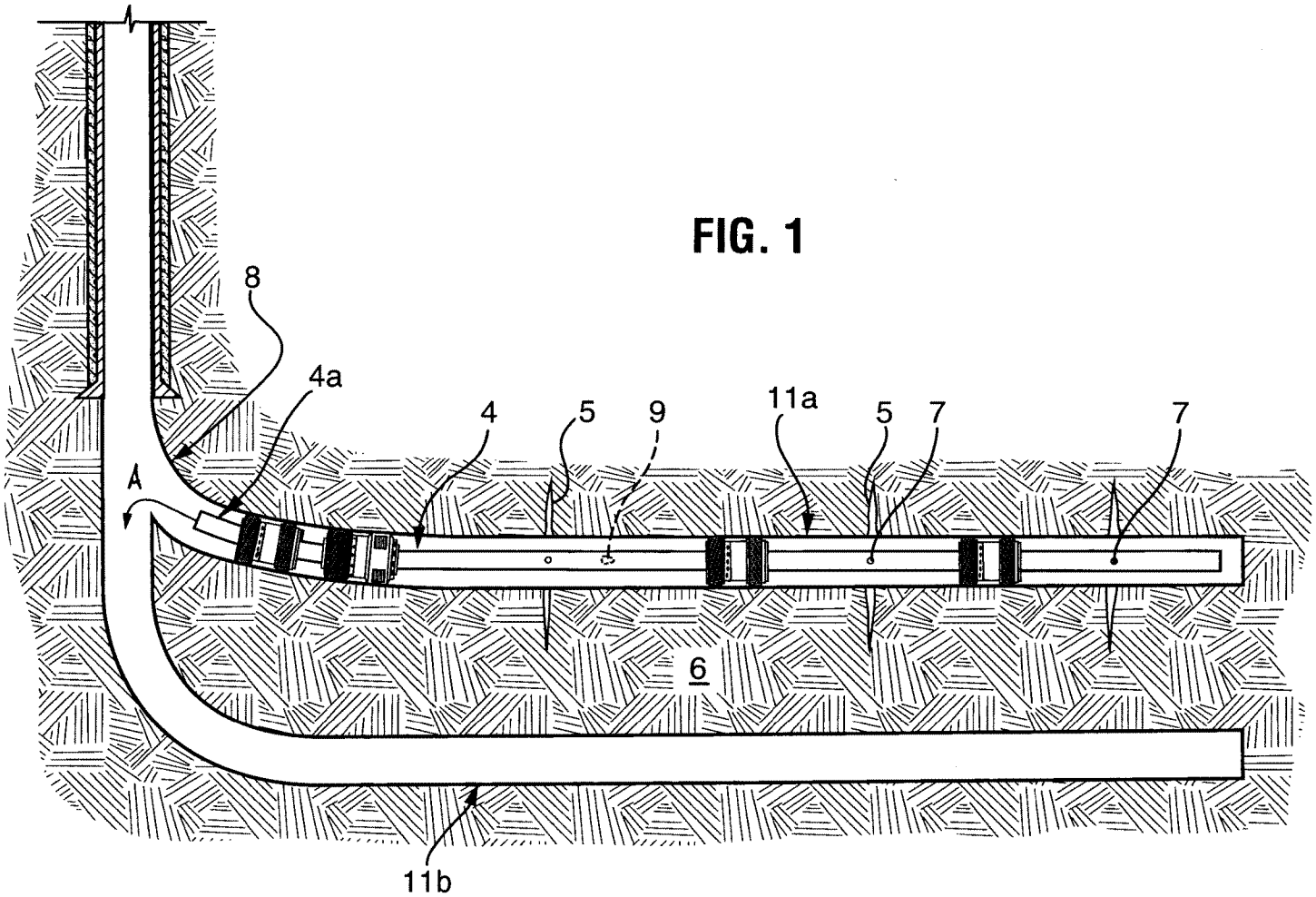
FIG. 1 is a schematic view of a multi-leg well.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

The apparatus and methods of the present invention can be used in various borehole conditions including an open hole, a lined hole, a vertical hole, a non-vertical hole, a main wellbore, a wellbore leg, a straight hole, a deviated hole or various combinations thereof.

With reference to FIG. 1, however, a multi-leg well is shown schematically for illustration purposes. A multi-leg well is formed through a formation 6 and includes a main wellbore 8 and a plurality of wellbore legs 11*a* and 11*b* that extend from the main wellbore. While a dual lateral well with two wellbore legs is shown, a multi-leg well may include any number of legs. If desired, one or more of the legs can be treated as by lining, stimulation, fracing, etc. For example, one or more of the legs may have installed therein a wellbore treatment apparatus 4 through which wellbore fluid treatment such as fracing to form fractures 5 is affected. In some embodiments, the wellbore treatment apparatus may include plug activated sliding sleeves driven by plugs (a plug 9 is shown in broken line form, as it is located within the apparatus) that pass into and along the apparatus to create pressure differentials to control the open/closed condition of ports 7. If such a wellbore treatment apparatus is used in a multi-leg well, the movement of one or more of the plugs out of the apparatus and/or the wellbore leg in which they were employed may interfere with wellbore operations in other parts of the well. For example, if wellbore leg 11*a* has installed therein a plug activated wellbore treatment apparatus 4, a stray plug from wellbore leg 11*a* can, by flowing along arrow A, pass out of the upper end 4*a* of the apparatus and inadvertently interfere with operations in the well for example, operations in wellbore leg 11*b*. For example, a plug could move along line A and prevent a string from being run into that wellbore leg or, if an apparatus is installed in leg 11*b*, block access to that apparatus or interfere with its operation. For example, if a plug activated wellbore treatment apparatus is installed in leg 11*b*, the plug 11*a* could move along a path as shown by arrow A and block off a seat in the apparatus and prevent access to components of the apparatus below, such as smaller diameter sleeve seats, of the apparatus in wellbore leg 11*b*.

A wellbore tubing string apparatus according to an aspect of the invention may provide for retention of a sleeve actuating plug in the tubing string to act against movement of the plug out of the tubing string into which they were introduced. In another aspect a wellbore treatment process is provided that has positional control over the position of the one or more sleeve actuating plugs employed therein, to prevent them from passing upwardly out of the tubing string until it is acceptable to do so.

Figure 2A:
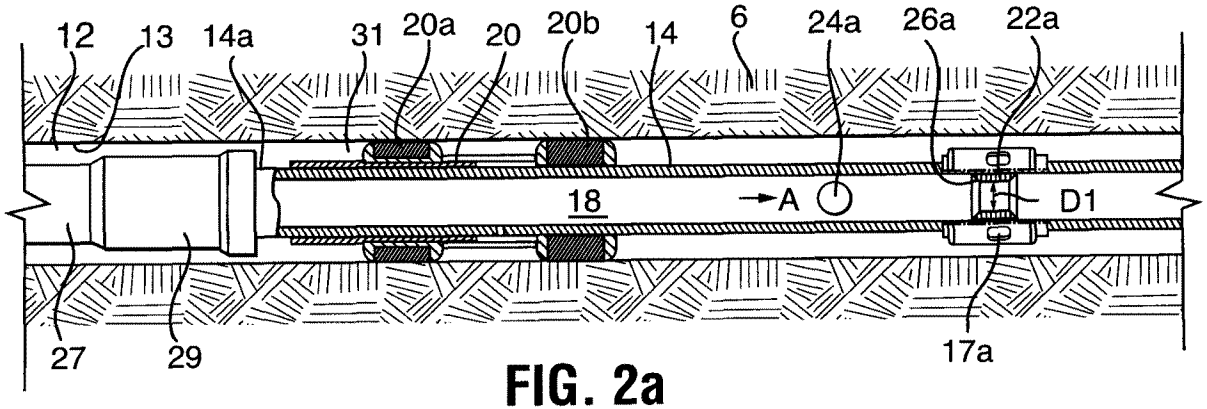
FIGS. 2*a* and 2*b* are sectional view through a wellbore and a fluid treatment assembly positioned therein.
Figure 2B:
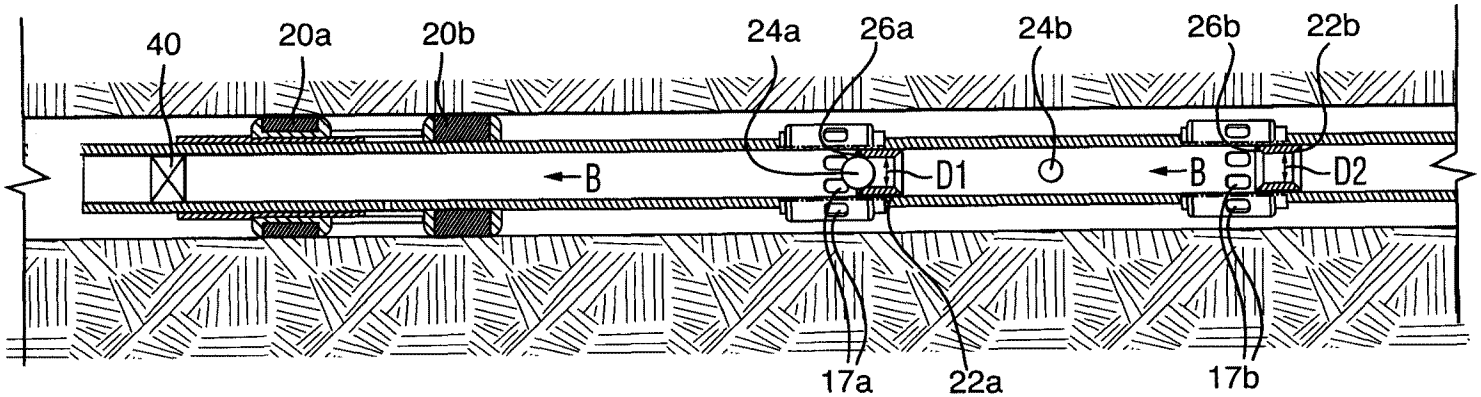

Referring to FIGS. 2*a* and 2*b*, a portion of wellbore fluid treatment apparatus is shown positioned in a wellbore 12 and which includes a plug-actuated tool. While other string configurations are available with plug-actuated tools, the present apparatus includes a plurality of plug-actuated sliding sleeves in a staged arrangement. In the assembly illustrated the sleeves are used to control fluid flow through the string and the string can be used to effect fluid treatment of a formation 6 through a wellbore 12 defined by a wellbore wall 13, which may be open hole (also called uncased) as shown, or cased. The wellbore assembly includes a tubing string 14 having an upper end 14*a* which is accessible and may be communicated from surface (not shown). Upper end 14*a* is open and provides access to an inner bore 18 of the tubing string. Tubing string 14 may be formed in various ways such as by an interconnected series of tubulars, by a continuous tubing length, etc., as will be appreciated. Tubing string 14 includes at least one interval including one or more ports 17*a* opened through the tubing string wall to permit access between the tubing string inner bore 18 and wellbore wall 13. Any number of ports can be provided in each interval. The ports can be grouped in one area of an interval or can be spaced apart along the length of the interval.

A sliding sleeve 22*a* is disposed in the tubing string to control the open/closed state of ports 17*a* in each interval. In this embodiment, sliding sleeve 22*a* is mounted over ports 17*a* to close them against fluid flow therethrough, but sleeve 22*a* can be moved away from a port closed position covering the ports to a port open position, in which position fluid can flow through the ports 17*a*. In particular, the sliding sleeve is disposed to control the opening of the ports of the ported interval through the tubing string and are each moveable from a closed port position, wherein the sleeve covers its associated ported interval (FIG. 2*a*) to a position not completely covering the ports wherein fluid flow of, for example, stimulation fluid is permitted through ports 17*a* (as shown by FIG. 2*b*). In other embodiments, the ports can be closed by other means such as caps or second sleeves and can be opened by the action of a sliding sleeve moving through the string to break open or remove the caps or move the second sleeves.

Often the assembly is run in and positioned downhole with the sliding sleeve in its closed port position and the sleeve is moved to its open port position when the tubing string is ready for use in fluid treatment of the wellbore.

Sliding sleeve 22*a* may be moveable remotely between its closed port position and its open port position (a position permitting through-port fluid flow), without having to run in a line or string for manipulation thereof. In one embodiment, the sliding sleeve may be actuated by a plug, such as a ball 24*a* (as shown), a dart or other plugging device, which can be conveyed in a state free from connection to surface equipment, as by gravity or fluid flow, into the tubing string. The plug is selected to land and seal against the sleeve to move the sleeve. For example, in this case ball 24*a* engages against sleeve 22*a*, and, when pressure is applied through the tubing string inner bore 18 through upper end 14*a*, ball 24*a* seats against and creates a pressure differential across the sleeve and the ball seated therein (above and below) the sleeve which drives the sleeve toward the lower pressure (bottomhole) side.

In the illustrated embodiment, the inner surface of sleeve 22*a* which is open to the inner bore of the tubing string has defined thereon a seat 26*a* onto which an associated plug such as ball 24*a*, when launched from surface, can land and seal thereagainst. When the ball seals against sleeve seat 26*a* and pressure is applied or increased from surface, a pressure differential is set up which causes the sliding sleeve on which the ball has landed to slide to a port-open position. When the ports of the ported interval are opened, fluid can flow therethrough to the annulus between the tubing string and the wellbore wall 13 and thereafter into the formation 6.

While only one sleeve is shown in FIG. 2*a*, the string may include further ports and/or sleeves below sleeve 22*a*, on an extension of the length of tubing string extending opposite upper end 14*a*. Where there is a plurality of sleeves, they may be openable individually to permit fluid flow to one wellbore segment at a time, in a staged treatment process. In such an embodiment, for example, each of the plurality of sliding sleeves may have a different diameter seat and, therefore, may each accept a different sized plug. In particular, where there is a plurality of sleeves and it is desired to actuate them each individually, the lower-most sliding sleeve has the smallest diameter seat and accepts the smallest sized ball and each sleeve that is progressively closer to surface has a larger seat and requires a larger ball to seat and seal therein. For example, as shown in FIG. 2*b*, sleeve 22*a* is closest to surface and includes a seat 26*a* having a diameter D1 which is sealable by ball 24*a* and therebelow a sleeve 22*b* controls the open/closed condition of ports 17*b* and includes a seat 26*b* having a diameter D2 which is less than D1 and which is sealable by a ball 24*b* that can pass through D1 but not D2. Any sleeves below the sleeve for ball 24*b* will include diameters smaller than D2. This provides that the sleeve closest to the lower end, toe of the tubing string can be actuated first to open its ports by first launching the smallest ball, which can pass though all of the seats of the sleeves closer to surface but which will land in and seal against the lowest sleeve.

While plugs and fluid can be conveyed in various ways through the wellbore to upper end 14*a*, a communication string 27 can be employed to latch onto upper end 14*a* and provide communication from a bore of string 27 to inner bore 18. A communication string 27 may facilitate fluid communication to string 14 and can be connected to string via a connector 29.

One or more packers, such as packer 20, may be mounted about the string to, when set, seal an annulus 31 between the tubing string and the wellbore wall, when the assembly is disposed in the wellbore. The packers may be positioned to seal fluid passage through the annulus and/or may be positioned to create isolated zones along the annulus such that fluids emitted through each ported interval may be contained and focused in one zone of the well. For example, packer 20 may be positioned between ports 17*a* and upper end 14*a* to prevent fluid introduced through ports 17*a* from flowing through annulus 31 into the remainder of the well above end 14*a*. If desired, there may be a further packer between ports 17*a* and ports 17*b*. Further packers may be mounted between each pair of adjacent ported intervals or at other positions along the tubing string. The packers may divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, a packer below the lowest ported interval may or may not be needed in some applications.

The packers may take various forms. Those shown are of the solid body-type with at least one extrudable packing element, for example, formed of rubber. Solid body packers including multiple, spaced apart expandable packing elements 20*a*, 20*b* on a single packer mandrel are particularly useful especially, for example, in open hole (unlined wellbore) operations. In another embodiment, a plurality of packers are positioned in side-by-side relation on the tubing string, rather than using one packer between each ported interval. The packers can be set by various means, such as plug actuation, hydraulics (including piston drive or swelling), mechanical, direct actuation, etc.

The lower end of the tubing string can be open, closed or fitted in various ways, depending on the operational characteristics of the tubing string that are desired. For example, in one embodiment, the end includes a pump-out plug assembly. A pump-out plug assembly acts to close off the lower end during run in of the tubing string, to maintain the inner bore of the tubing string relatively clear. However, by application of fluid pressure, for example at a pressure of about 3000 psi, the plug can be blown out to permit fluid flow through the string and, thereby, the generation of a pressure differential. As will be appreciated, an opening adjacent lower end is only needed where pressure, as opposed to gravity, is needed to convey the first ball to land in the lower-most sleeve. Alternately, the lower-most sleeve can be hydraulically actuated, including a fluid actuated piston secured by shear pins, so that the sleeve can be opened remotely without the need to land a ball or plug therein.

In other embodiments, not shown, the end can be left open or can be closed for example by installation of a welded or threaded plug.

Centralizers and/or other standard tubing string attachments can be used, as desired.

In use, the wellbore fluid treatment apparatus, as described with respect to FIGS. 2*a* and 2*b*, can be used in the fluid treatment of a wellbore. For selectively treating formation 6 through wellbore 12, the above-described string is run into the borehole and the packers are set to seal the annulus at each packer location. Fluids can then be pumped down the tubing string and into a selected zone of the annulus, such as by increasing the pressure to pump out the plug assembly. Alternately, a plurality of open ports or an open end can be provided or lower most sleeve can be hydraulically openable.

Once a selected zone is treated, as desired, ball 24*b* or another type of sealing plug is launched from surface and conveyed by gravity or fluid pressure to seal against the seat of its target sliding sleeve. Ball 24*b* seals off the tubing string below its sleeve and opens the ported interval of its sleeve to allow fluid communication between inner bore 18 and annulus 31 and permit fluid treatment of the formation therethrough. Ball 24*b* is sized to pass though all other seats between upper end 14*a* and seat 26*b*, but will be stopped by and seal against seat 26*b*. After ball 24*b* lands, a pressure differential can be established across the ball/sleeve which will eventually drive the sleeve to the low pressure side and, thereby open the ports covered by the sleeve.

After fluid treatment is complete through the ports associated with ball 24*b*, ball 24*a* is launched, which is sized to be caught in seat 26*a*. Ball 24*a* is conveyed by fluid or gravity to move through the tubing string, arrow A (as shown in FIG. 2*a*), to eventually seat in, seal against and move sleeve 22*a*. This opens ports 17*a* and permits fluid treatment of the annulus below packer 20. The balls can be launched without stopping the flow of treating fluids.

The apparatus is particularly useful for stimulation of a formation, using stimulation fluids, such as for example, acid, gelled acid, gelled water, gelled oil, $CO_2$, nitrogen and/or proppant laden fluids. The apparatus may also be useful to open the tubing string to production fluids.

While the illustrated embodiment, shows only two balls, it is to be understood that the numbers of ported intervals in these assemblies can be varied. In a fluid treatment assembly useful for staged fluid treatment, for example, at least two openable ports from the tubing string inner bore to the wellbore are generally provided such as at least two ported intervals or an openable end and one ported interval.

After treatment, once fluid pressure is reduced from surface, the pressure holding the uppermost ball in its sleeve seats will be dissipated. As shown in FIG. 2*b*, balls 24*a*, 24*b* may be unseated by pressure from below and may begin to move upwardly arrows B through the tubing string. In a prior art system, if the communication string is detached from the upper end, the balls may pass upwardly out through upper end and move into the wellbore. However, in the illustrated embodiment, a plug retainer 40 is provided to retain plugs in the tubing string, preventing them from passing upwardly out of and exiting the tubing string. Plug retainer 40 may permit the plugs to lift off their seats, but is formed and positioned to retain the plugs in the tubing string.

The plug retainer may take various forms. For example, it may entirely be installed in the string before it is run in or it may in whole or in part be conveyed down to become installed in the tubing string when it is deemed an appropriate time to do so, for example after all balls 24*a*, 24*b* of interest have been conveyed into the string. As another example, the plug retainer may be selected only to move into a retaining position after the ball actuation process is complete or the plug retainer may be selected to continuously be in a position blocking reverse plug movement out of the upper end of the tubing string. As a further example of options, the plug retainer may seal all movement of plugs and fluid upwardly out of the tubing string or may prevent plug movement while allowing fluid passage upwardly (toward surface) therepast. As another possible option, the plug retainer, once in place in a retaining position, may be permanent or may be removable. As a further possible option, the plug retainer may inhibit downward access of fluid and/or equipment therepast or may allow passage of fluid and at least some equipment (for example: lines). Of course, various combinations of these options are also possible.

As will be appreciated from the foregoing options, the plug retainer may take various forms. As an example, the plug retainer may include a gate, such as a spring, collet finger or a flapper, that protrudes into the inner bore. As another example, the plug retainer may include a separately installable-type ball retainer, which includes a separate body that is conveyed from surface to become secured in the tubing string.

Figure 3A:
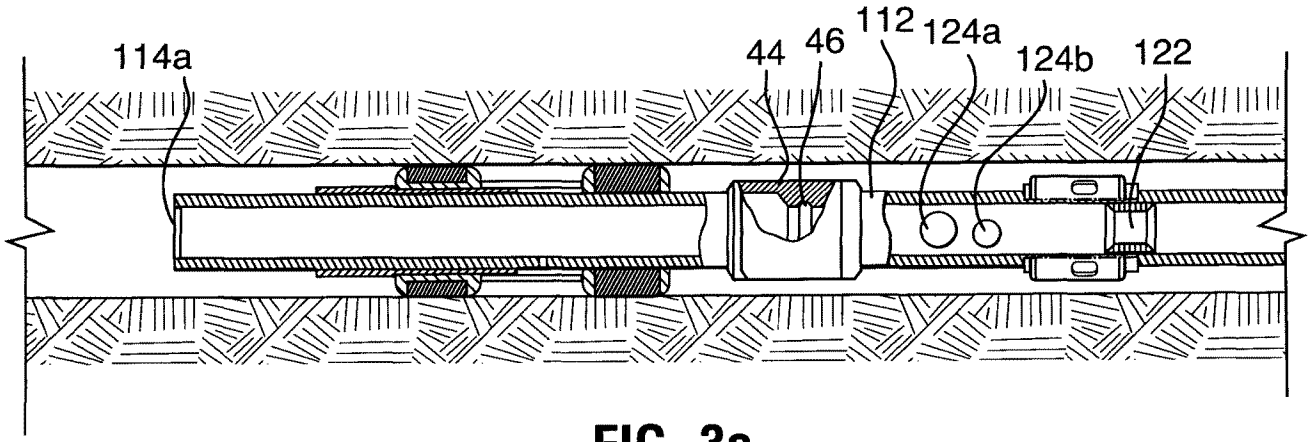
FIGS. 3*a*, 3*b* and 3*c* are sequential sectional views through a fluid treatment assembly according to one aspect of the present invention.
Figure 3B:
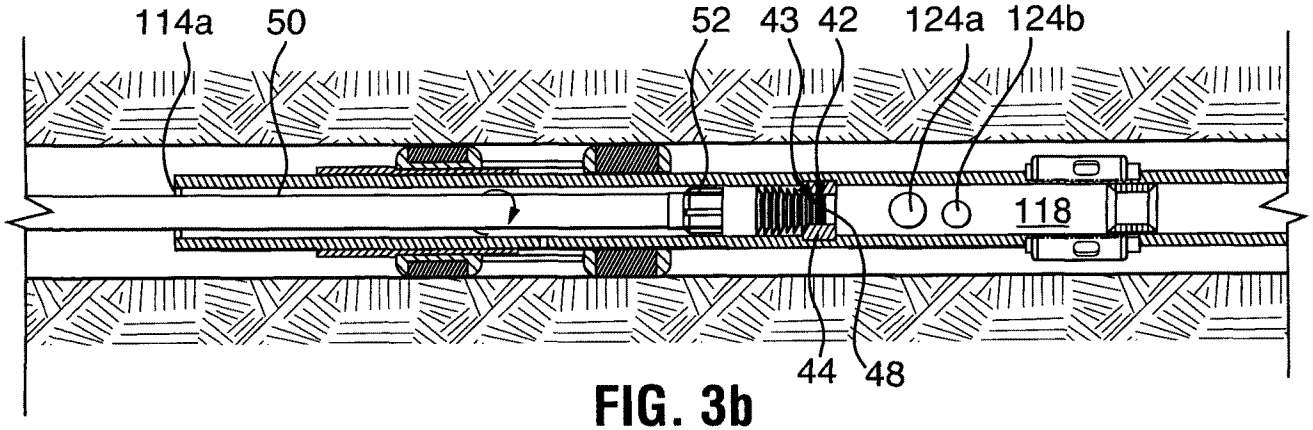
Figure 3C:
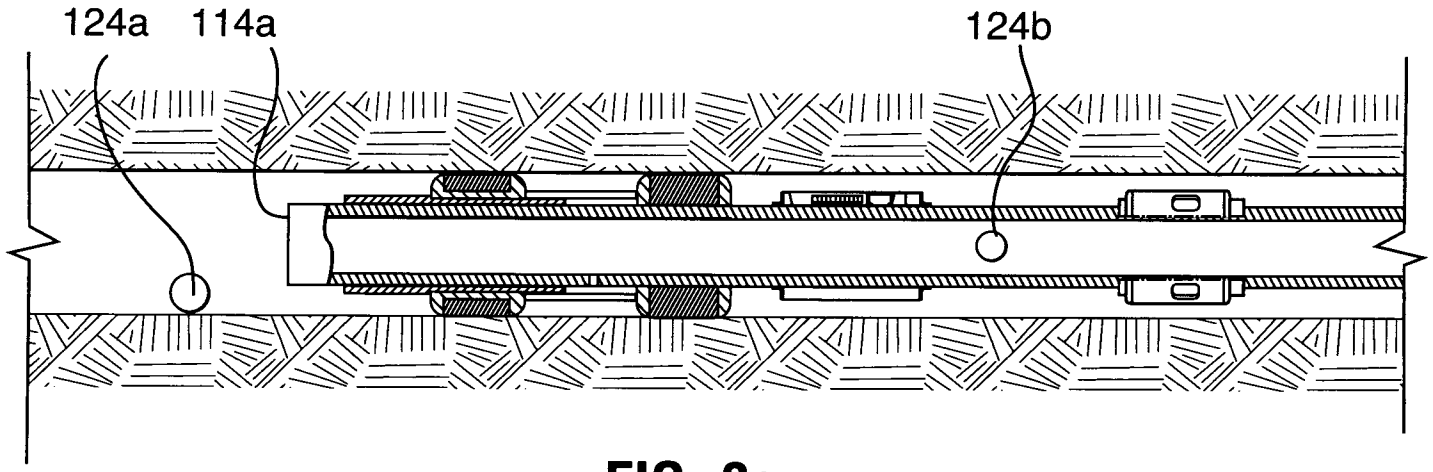
Figure 4:
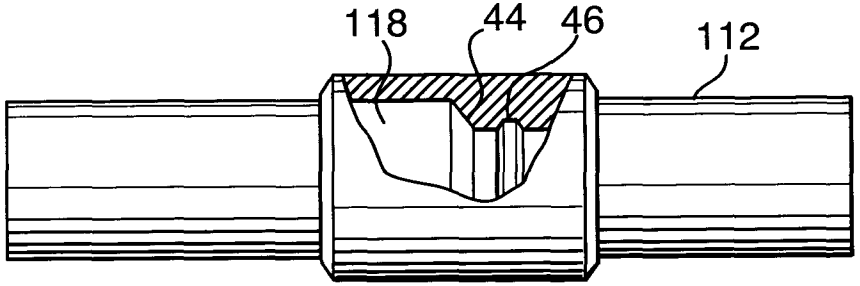
FIG. 4 is an enlarged, cutaway view of a portion of the fluid treatment assembly of FIG. 3*a;*

One possible embodiment of a plug retainer is shown in FIGS. 3*a* to 3*c*. FIG. 3*b* shows a ball retainer including a fluid conveyed body 42, which may free of any connections to surface or may be connected by wireline, and formed to become engaged in a tubing string 112 to prevent balls 124*a*, 124*b* or other plug forms from moving upwardly therepast out of the upper end 114*a* of the tubing string. The body may include fins 43 that facilitate and stabilize the movement of the plug retainer body through the well by fluid flow to the tubing string. To hold body 42 in the tubing string, the tubing string may include an engaging profile 44 (also shown in FIG. 4) including locking structures, such as an annular recess 46, to accept and retain outwardly biased locks 48 such as dogs, detents, c-rings, etc. on the body. The profile may be installed in the tubing string before it is run into the hole and may be selected to have a minimum inner diameter that is at least large enough to allow ball 124*a* to pass. The profile may be positioned anywhere between the uppermost plug-actuated site, such as sleeve 122, and upper end 114*a*. In one embodiment, the profile is distanced away from upper end 114*a* such that a space exists between the upper end and the profile into which wellbore strings and tools may be inserted and stabilized relative to/lined up with the profile or any body in the profile.

If desired, the plug retainer body may be removable from profile, when it is no longer needed, such as by acid dissolution or by drilling out, as shown in FIG. 3*b*. For example, to reopen the tubing string inner bore 118 to fluid flow and passage of tools, the plug-retainer body 42 and possibly the profile 44, if such protrudes into inner bore 118, can be drilled out by inserting a drilling string 50 and cutting head 52 through the wellbore to the body and manipulating the head 52, as by rotation, to open bore 118 as shown in FIG. 3*c*. The body and the profile may include interacting anti-rotation structures, such as faceted regions or teeth, and may be formed of drillable materials to ensure drillability. If body 42 is drilled out, balls 124*a* and 124*b* may flow through the tubing string 112 towards upper end 114*a*.

In another embodiment, the body may be removed by a spear that engages the body and pulls it out of its locked position. For example, the spear may engage a fishing-type profile on the body or may dig into the material of the body. The spear may be moved to engage and release the body by applying a pull force thereto. The pull force may be generated, for example, by hydraulics or by connection to surface through a line or string. In one embodiment, for example, the spear may be installed on an end of the communication line and may be placed into engagement with the separately installable plug retainer body by adjacent positioning or possibly connection of the communication line. The spear may be installed on an end of the communication line by pumping into that position through the line or by preinstallation, as desired.

Once the body is removed, as shown in FIG. 3*c*, the tubing string 114 becomes opened for fluid flow, as well as flow back of balls 124*a*, 124*b*. As such, the body will likely only be removed when the flow back of balls will not complicate other wellbore operations. For example, body 42 might only be removed in one embodiment, after wellbore operations in other wellbore legs of interest are substantially completed.

Figure 5C:
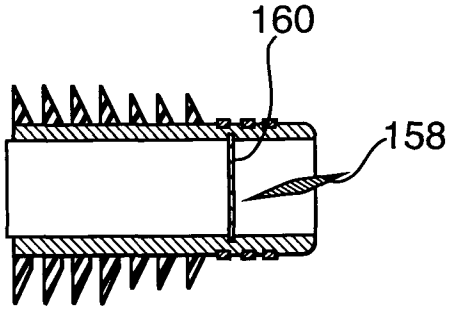
FIGS. 5*a*, 5*b* and 5*c* are side elevation, side sectional pump in and side sectional landed views, respectively, of a plug useful in the present invention.
Figure 5B:
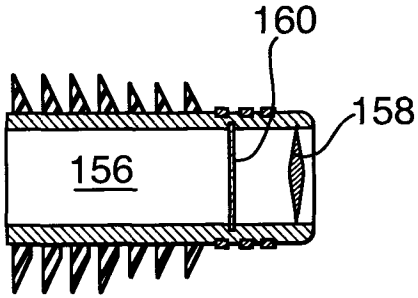
Figure 5A:
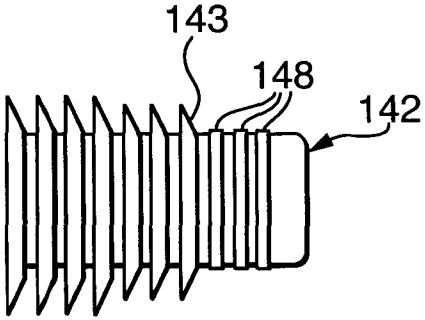

FIGS. 5*a*, 5*b*, and 5*c* show another separately installable-type ball retainer formed as body 142 useful in one aspect of the present invention. The body may include fins 143 that facilitate and stabilize the movement of the body through the well by fluid flow to the tubing string. Spring biased expansion rings 148 on the body's leading, nose end act to lock the body into an annular recess 149 in the tubing string. The bore may include a bore 156 through its body from the leading end to the trailing end to permit, when open, fluid flow therethrough. A seal, such as a burst disc 158, may be installed in bore 156 to permit pumping conveyance of the body to and into the tubing string. However, once the body 142 is landed in its position in the tubing string the seal may be overcome to open bore 156. In an embodiment employing burst disc 158 as a seal, the bore may be opened by achieving burst pressures above the disc. The body may also include a screen 160, if desired, to prevent the balls from moving through bore 156, even after the burst disc is open. Balls may accumulate against the screen, but fluid can flow therepast through the bore.

Figure 6:
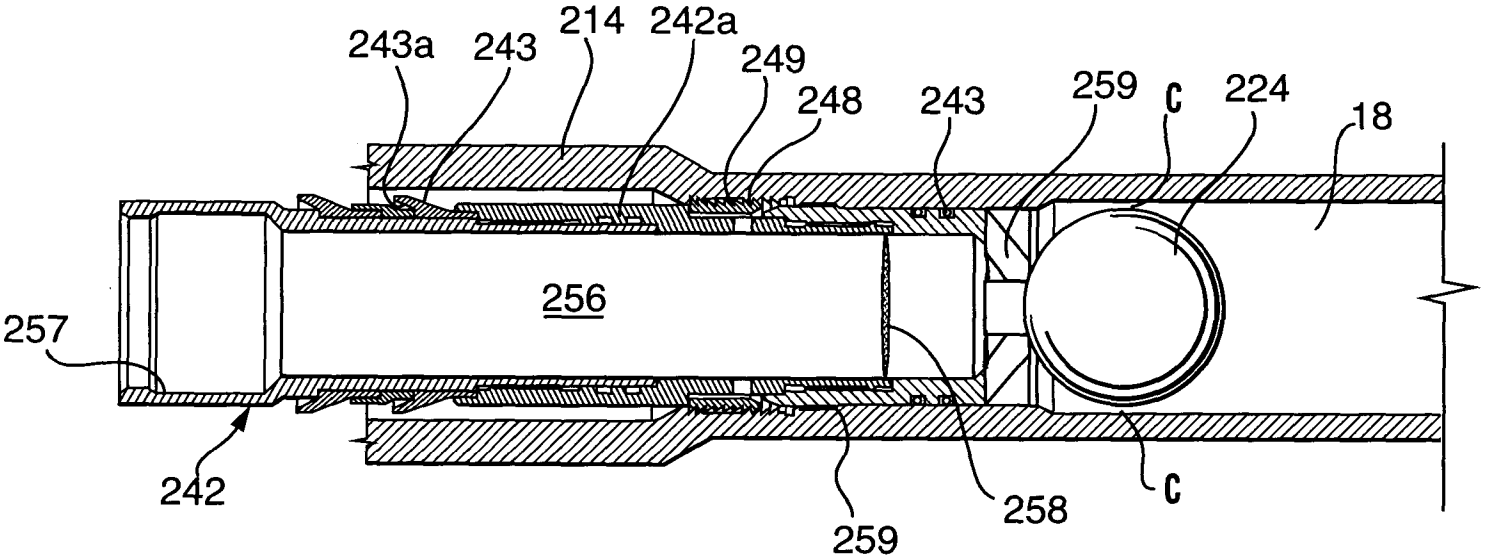
FIG. 6 is a sectional view through another plug landed in a tubing string.

FIG. 6 shows another plug retainer 242 useful in one aspect of the present invention. The plug retainer may include a body 242*a* with fins 243 extending radially outwardly therefrom forming annular seals that can inflate by fluid pressure applied against their acutely angled faces 243*a* (extending toward the body's trailing end) and will seal the annular area between the body and a tubing string 214 in which it is installed to facilitate and stabilize the movement of the body by fluid flow through the tubing string. An externally exposed ratchet surface 248 on the body's outer diameter acts to lock the plug retainer into an exposed profile 249 on the inner diameter surface of tubing string inner bore 18. The plug retainer may include a bore 256 through its body from its leading end to its trailing end to permit fluid flow therethrough. A seal, such as a burst disc 258, may be installed in bore 256 to permit pumping conveyance of the body. However, the seal may be overcome to open the bore once the plug retainer is landed in its position in the tubing string. In an embodiment employing a burst disc, the burst disc may be manipulated to open the bore by achieving burst pressures above the disc. Burst pressure may be relatively low, such as between 500 and 1500 psi and possibly between 750 and 1250 psi. Such pressures may be readily achieved once the body is stopped against fluid conveyance, such as when the body reaches profile 259 in the tubing string ID. Seals 243 may be positioned to resist fluid leakage between the body and the tubing string wall. However, after burst is achieved, fluid can flow in both directions through bore 256. The body may also include a screen 259, if desired, to prevent a plug, such as ball 224, from plugging fluid flow, or passing upwardly, through the bore. The screen can include open areas, but they are smaller than the outer diameter of at least some of the balls. As will be appreciated, the uppermost ball may be the largest ball and since it will be the ball that comes first against the screen, the screen may include openings sized to prevent the passage of the largest ball therethrough, without concern (if desired) to the smaller balls to be used. In one embodiment, however, the screen can have openings selected to exclude even the smallest ball to be used in actuation of any downhole tool.

The inner diameter of the tubing string adjacent profile 249 at least on the ball-stopping (downhole) side can be slightly larger than the largest ball, such that when the largest ball is stopped against the screen in the plug retainer, a clearance (at C) remains between the outer diameter of the ball and the inner diameter of the tubing string such that fluid can flow therepast.

In this illustrated embodiment, the plug retainer may be drillable. For example, at least body 242*a* may be formed of drillable materials and ratchets 248 and profile 249 can have a thread form that limits rotation of the body relative to the tubing string. The anti-rotation feature of ratchets 248 and profile 249 holds the plug retainer steady against drilling rotation of the drill bit. Alternately or in addition, the plug retainer may include a fishing neck 257 to permit latching thereto such as to apply a pulling force to separate the body from ratchets 248.

Figure 7A:
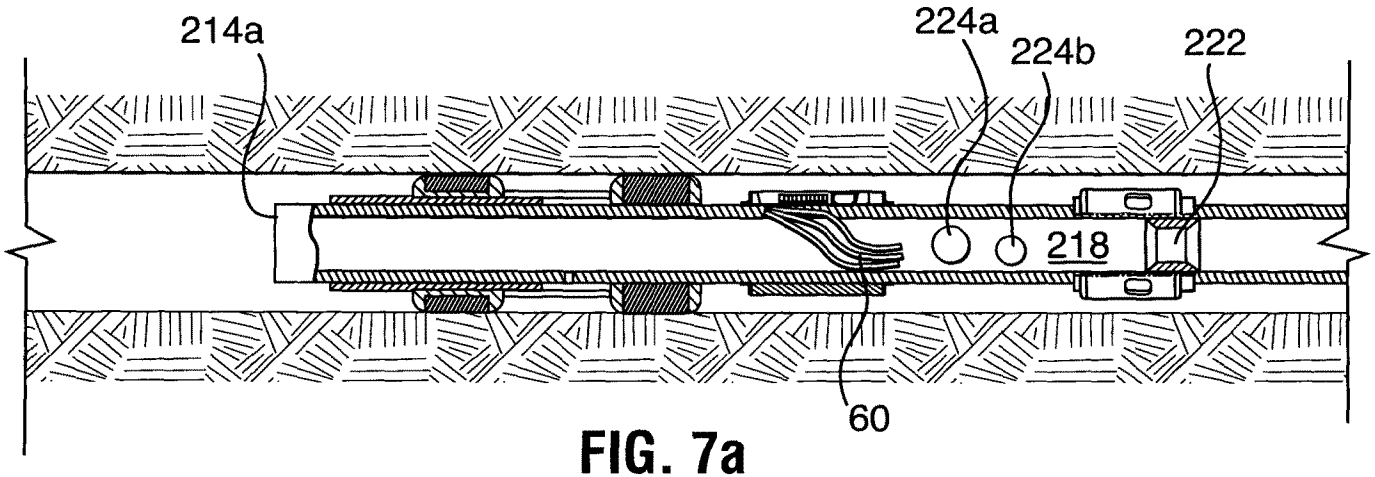
FIGS. 7*a* and 7*b* sequential sectional views through a fluid treatment assembly according to another aspect of the present invention.
Figure 7B:
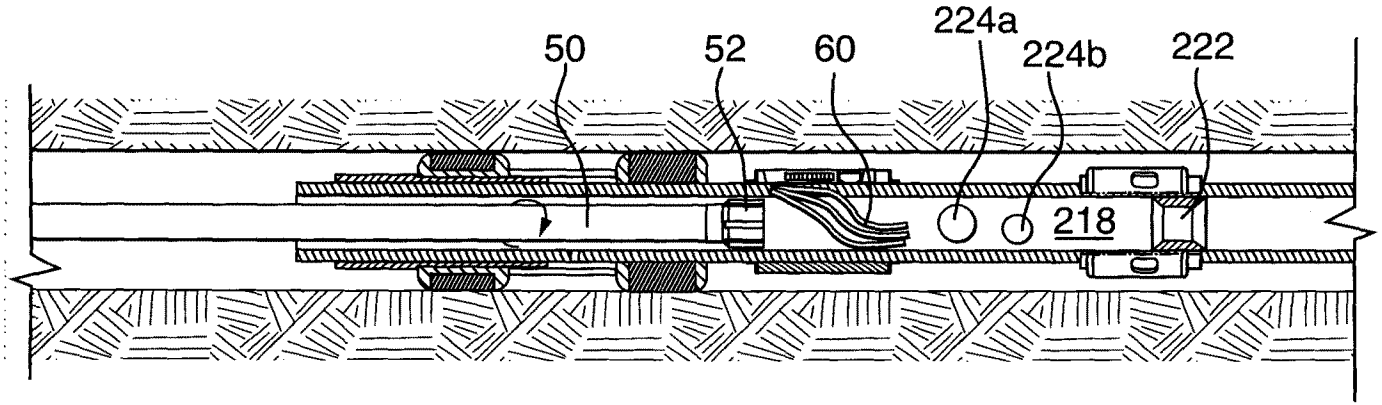

Another possible embodiment of a plug retainer is shown in FIGS. 7*a* and 7*b*. FIG. 7*a* shows a gate-type plug retainer including one or more fingers 60 that protrude into the inner bore 218 of a tubing string in which they are installed. Fingers 60 prevent balls 224*a*, 224*b* from moving upwardly therepast out of the upper end of the tubing string but allow fluids to flow therepast. The fingers 60 are angled from their mounting position toward sleeve 222 and formed of a resilient and durable material, such as resilient polymers, spring steel, aluminium, etc. that prevents them from being pushed out of the way in a direction from sleeve 222 to upper end 214*a*, such that balls 224*a*, 224*b* are prevented from moving past the fingers upwardly out of the tubing string. The fingers may be sized and/or grouped in the tubing string to restrict movement therepast of at least the uppermost ball. The fingers may be spaced to define spaces therebetween such that fluid can continue to flow therepast in both directions. The fingers may be installed in the tubing string before run in, but may be overcome by structures such as balls 224*a*, 224*b* moving downwardly, from upper end 214*a* toward sleeve 222 and therepast. If line manipulation may be necessary during operations; however, fingers 60 may have to be formed with consideration to avoiding catching on line-type manipulators as they are moved therepast. However, if considerable line manipulation may be of interest, fingers 60 may not be particularly convenient. Fingers 60 may be installed on the inner wall of the tubing string or in an insert at a tubular connection along the tubing string. The fingers may be positioned anywhere between the upper most ball landing position, here illustrated as sleeve 222 and upper end 214*a* so that if a fracturing string or stimulation string is disconnected from the tubing string (as shown in FIG. 7*a*) the balls remain downhole of the gate-type plug retainer. If the ball retainer is intended to operate while allowing continued flow of fluids towards surface therepast, sleeve 222 may be selected such that it doesn't create a seal with any balls from below. For example, sleeve 222 and any balls intended to be conveyed below sleeve 222, should be selected with mutual consideration such that the balls can pass through the inner diameter of the sleeve, or a fluid bypass may be required.

If desired, the fingers may be removable such as by acid dissolution or by drilling out, as shown in FIG. 7*b*. For example, to reopen the tubing string inner bore 218 to fluid flow and passage of tools and balls, the fingers, to the extent that they protrude into inner bore 218, can be drilled out by inserting a drilling string 50 and cutting head 52 through the wellbore and manipulating the head 52, as by rotation, to open the tubing string inner bore.

Once the fingers are removed, the tubing string 214 becomes opened for full bore access at least to sleeve 222, as well as for flow back of balls 224*a*, 224*b*. As such, the fingers may be left in place until it is considered that the flow back of the balls will not complicate other wellbore operations. For example, fingers 60 might only be removed in one embodiment, after wellbore operations in other wellbore legs of interest are substantially completed.

Figure 8A:
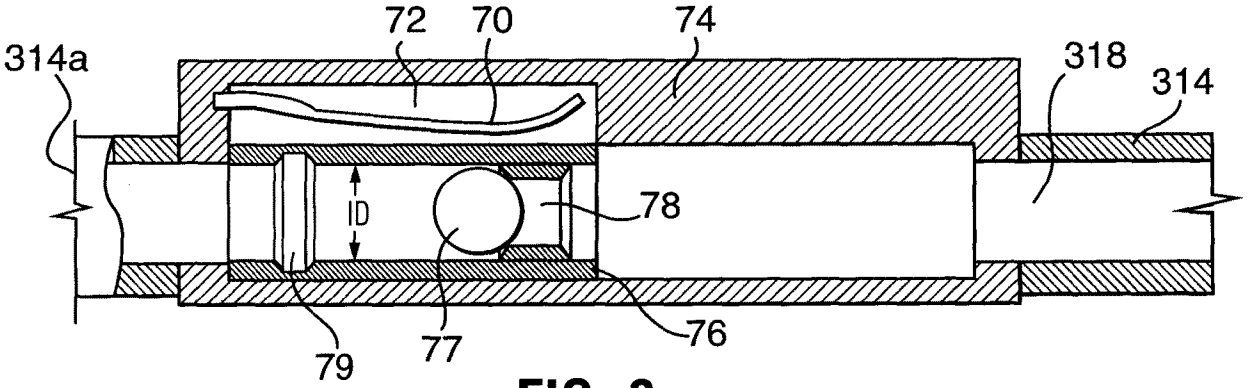
FIGS. 8*a* and 8*b* are sequential sectional views through a plug retainer according to another aspect of the present invention.
Figure 8B:
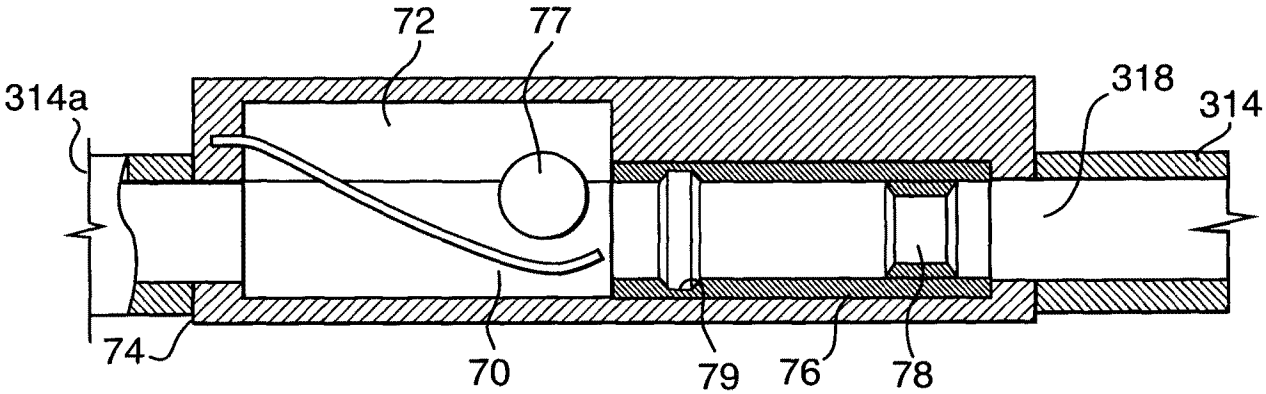

FIGS. 8*a* and 8*b* show another gate-type plug retainer including a spring biased gate finger 70 that is held out of the inner bore until released to protrude therein. Gate finger 70 may be in the form of one or more spring loaded structures such as rods or leaves that protrude into the flow path of the tubing string inner bore 318 to prevent balls, such as ball 77, from flowing back and out the upper end 314*a* of the tubing string 314. During tubing string run in and wellbore treatments, gate finger 70 is held in an inactive position out of the inner bore and out of the fluid flow path and out of the way of tools and actuation balls. In the illustrated embodiment of FIG. 8*a*, gate finger 70, when in the inactive position, is held in a recess 72 of a retainer housing 74 behind a sliding activation sleeve 76. When desired to release the gate finger into the tubing string inner diameter, and therefore into its plug blocking position, the sliding activation sleeve can be moved, which allows the gate finger 70 to move, as by its biasing force, into the inner bore. Sleeve 76 may be driven to move by use of a plug, such as ball 77, that lands on a sleeve seat 78 and drives the sleeve by fluid pressure. The plug, of course, also may be sized to be captured below the gate finger such that it also is retained against migrating out of the tubing string. The sleeve may have a full bore ID (an ID similar to that along the major portion of tubing string 314) of such that passage of liner tools, balls, etc. therepast is not adversely affected. Sleeve 76 may include a profile 79 to permit the sleeve to be engaged and actuated by a fishing tool on a line or other string. The gate finger can be removed from a retaining position by drilling, acid, or by forcing it against its biasing force back into the recess and moving the sleeve back into a capturing position over recess 72.

As noted above, finger 70 can be sized to prevent bypass of balls but does not block the entire inner diameter of the tubing string such that fluid flow can continue therepast. The recess 72 adjacent gate permits fluid bypass even around a ball 77 stopped against the gate finger.

Figure 9:
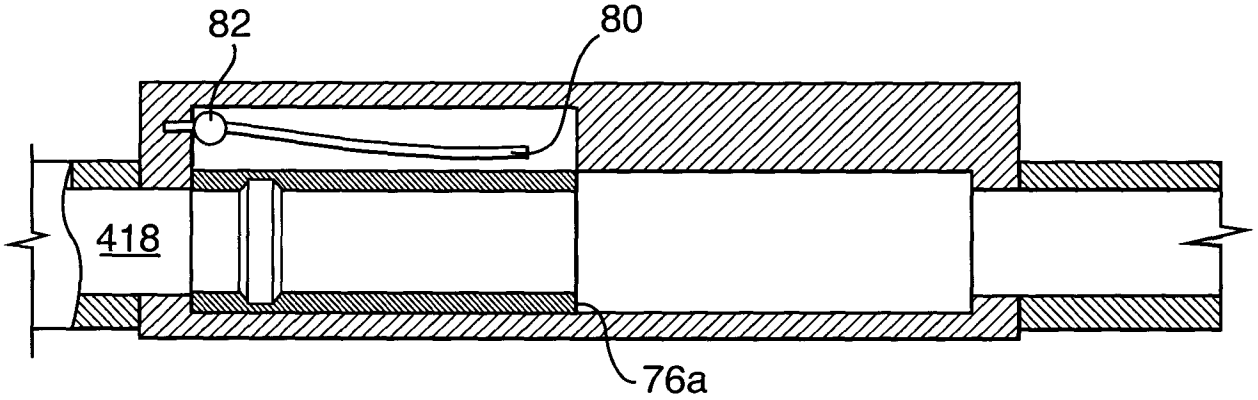
FIG. 9 is a sectional view through a plug retainer according to another aspect of the present invention.
Figure 10:
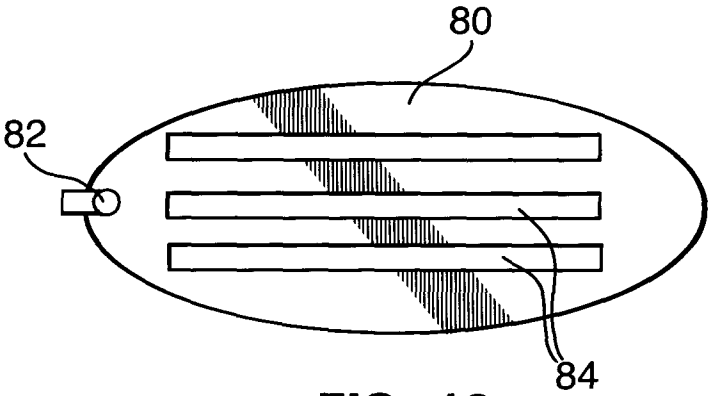
FIG. 10 is a top plan view of a plug retainer component useful in the plug retainer of FIG. 9.

FIGS. 9 and 10 show another gate-type plug retainer which includes a flapper 80 pivotally connected by a hinge 82 and biased into the flow path of a tubing string inner bore 418. As shown in FIG. 9, flapper 80 can be held against its biasing force out of the tubing string inner diameter as by a mechanism including a sleeve 76*a* similar to the mechanism including sleeve 76, if desired. As shown in FIG. 10, the flapper may include a screen thereon, defined by ports 84, through which fluid can pass but actuation balls, for the ball-actuated tools of tubing string 412, cannot.

Figure 11:
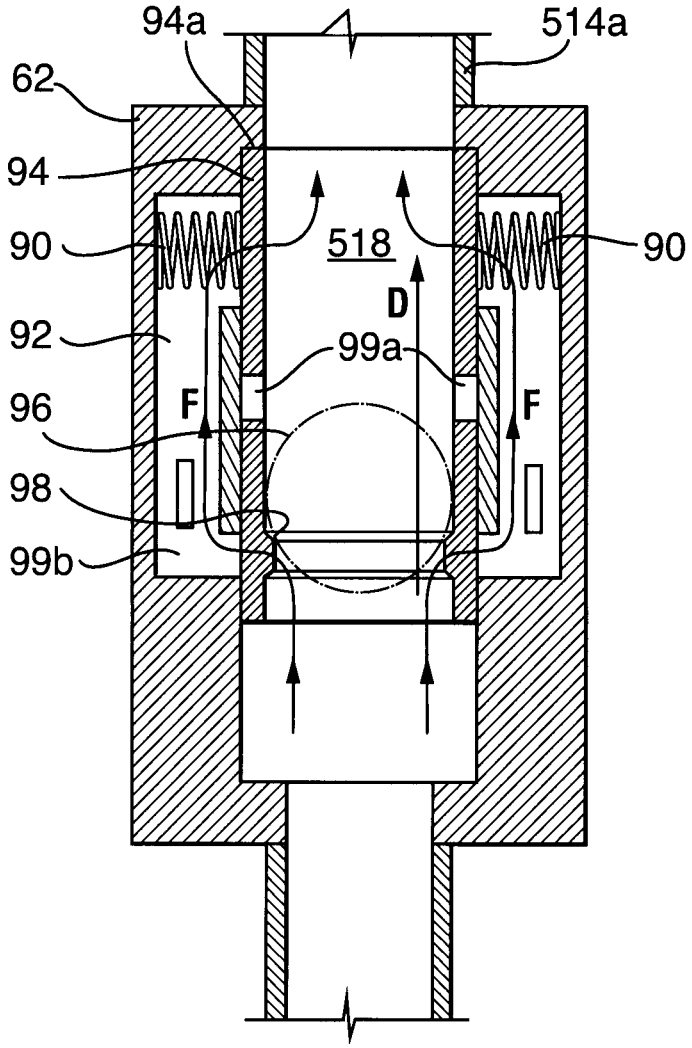
FIG. 11 is a sequential sectional view through a plug retainer according to another aspect of the present invention.

FIG. 11 illustrates another gate-type plug retainer. In this plug retainer, the gate includes one or more springs 90 biased to protrude into the inner bore 518 of a tubing string in which they are installed. While springs are normally held in a recess 92 out of the inner bore by a sleeve 94 thereover, when springs 90 protrude into the inner bore, they block any apparatus actuating plugs from moving therepast and outwardly through end 514*a* of a tubing string.

During tubing string run in and wellbore treatments requiring movement therepast of tools, actuation balls, etc., springs 90 are held out of the inner bore 518 in recess 92 of a retainer housing 95 behind activation sleeve 94, as is shown in FIG. 11. When it is desired to release the springs into the flow path through inner bore 518, the sliding activation sleeve can be moved, which allows the springs to bias into the inner bore. Sleeve 94 may be driven down away from the upper end 514*a* of the tubing string by use of a plug, such as a ball 96, that lands on a sleeve seat 98 and drives the sleeve by fluid pressure.

As noted above with respect to other gate-type plug retainers, the springs can be sized and/or grouped to prevent bypass of balls but can continue to permit fluid flow. Ball 96, of course, also may be sized to be captured below the springs. If ball 96, when captured, tends to restrict fluid flow back, along a direction shown by arrows D, through the sleeve, a fluid bypass may be provided. A fluid bypass may include, for example, sleeve ports 99*a* and channels 99*b* to permit fluid flow around the sleeve and any ball captured below the springs. In particular, ports 99*a* and channels 99*b* are positioned to be aligned when sleeve 94 is moved to expose springs 90. When the ports and channels substantially align, fluids can bypass around ball 96 which is trapped in sleeve below springs 90. In particular, a fluid path is set up from inner bore 518 below sleeve 94, through ports 99*a*, channels 99*b* and recess 92 and back into inner bore 518 above upper end 94*a* of the sleeve, arrows F. There may be a plurality of ports 99*a* spaced apart, as by multi-drilling, such that lower actuation balls may not readily block these flow ports. Alternately or in addition, a sufficient distance may be provided between trapped ball 96 and the uppermost sleeve of the tubing string such that the lower balls may pile up below trapped ball 96 and not block the fluid bypass. Alternately or in addition, seat 98 may be formed deformable such that it can catch ball 96 and retain it long enough to move the sleeve but will deform to release the ball to continue down the tubing string.

Figure 12A:
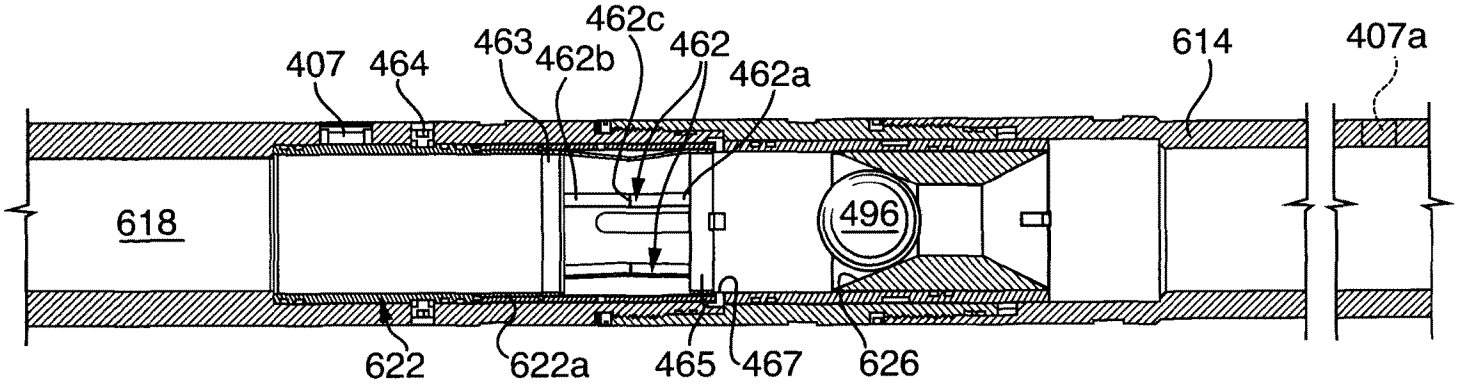
FIGS. 12*a* and 12*b* are sequential sectional views through another plug retainer according to another aspect of the present invention.
Figure 12B:
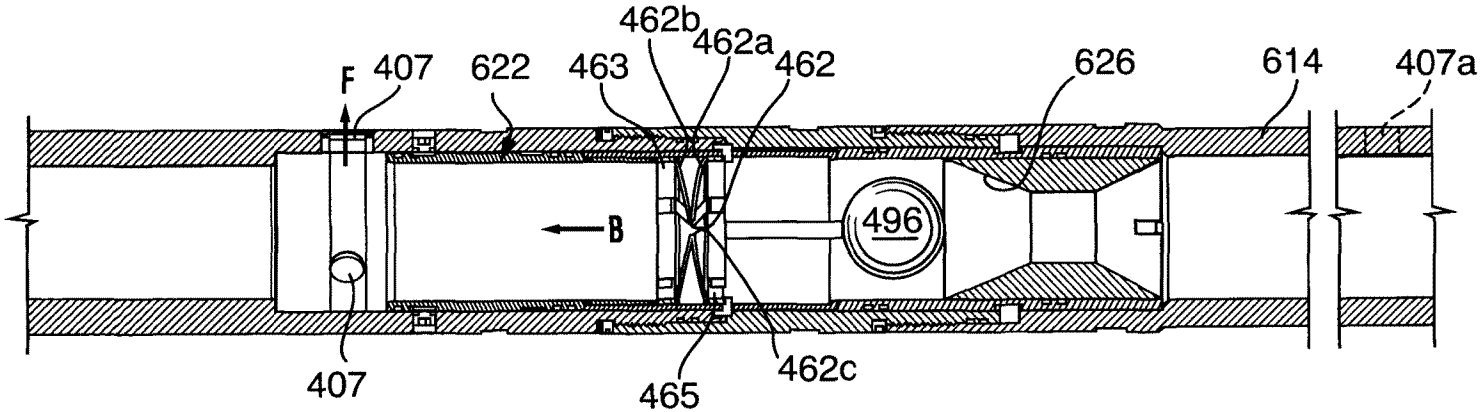

Another gate-type ball retainer is shown in FIG. 12. In the embodiment of FIG. 12, the ball retainer includes one or more fingers 462 protrudable into an inner bore 618 of a tubing string 614 in which they are positioned. Fingers 462 are positioned along the tubing string inner wall and have an elongate form which is positioned substantially axially aligned with the tubing string long axis. While fingers 462 are normally in a retracted position (FIG. 12*a*), lying generally flat adjacent the tubing string inner wall and substantially not affecting passage thereby of tools, actuation plugs, etc., they can be moved to an active position, shown in FIG. 12*b*, to protrude into the inner bore to block passage thereby of actuation balls of a size used to actuate tools in the tubing string. Fingers 462 are formed to protrude inwardly by folding inwardly in response to a compressing force applied thereto. For example, the fingers each include a first end 462*a* and an opposite end 462*b*. The fingers may be fixed at their first ends 462*a* such that they cannot move axially along the string 614 in which they are installed. However, opposite ends 462*b* are moveable axially along the string toward ends 462*a*. The fingers are further biased, as by selected folding at a mid point 462*c*, to collapse and protrude inwardly when opposite ends 462*b* are moved toward the first ends. Fingers 462 at least at their moveable, opposite ends 462*b* can be connected to a ring 463 that urges the fingers, where there is a plurality of them, to act as a unitary member and prevents the fingers from individually catching on structures, such as balls moving down therepast. In the illustrated embodiment, ends 462*a* are also joined by a ring 465. Ring 465 is set against shoulders 467 protruding inwardly from the tubing string inner wall such that it cannot move.

Fingers 462 are sized and/or grouped relative to the inner bore such that, when they are compressed to protrude inwardly, actuation balls used in the string cannot move therepast. However, open gaps remain between the fingers and the tubing string inner wall, to permit fluid flow to continue therepast even when the fingers are in an active position.

The ball retainer can be operated in various ways to move the fingers into the active, ball retaining position. For example, a tool can be actuated that drives ends 462*b* toward ends 462*a*. In the illustrated embodiment, the ball retainer is operated by movement of a sleeve 622. Opposite ends 462*b* are moved by sleeve 622, when the sleeve is moved axially through the tubing string. In the illustrated embodiment, sleeve 622 includes a seat 626 that can catch and seal with an actuation ball 496. When ball 496 lands and seals against the seat, the seal permits the generation of a pressure differential across the seat and ball that causes sleeve to shift down towards the low pressure side. Sleeve 622 can be pinned by releasable locks such as shear pins 464 to be secured against inadvertent movement, but will be overcome to release when the pressure differential is sufficiently established.

While various orientations are possible, the illustrated sleeve has seat 626 positioned downhole of the fingers and an upper section 622*a* uphole of the fingers that is connected to move with seat 626. When upper sleeve section 622*a* is moved with the seat, it bears against ends 462*b* while ends 462*a* are stopped against shoulders 467. As a result, the fingers collapse between section 622*a* and shoulders 467 and fold inwardly.

As noted above, the ball retainer is positioned somewhere between the upper end of the tubing string and the uppermost site of the ball actuation. In the illustrated embodiment, for example, the ball retainer is incorporated into a port opening sleeve. In particular, when sleeve 622 is moved, ports 407 are opened such that fluid can be pumped, arrow F, out from the inner bore. As such, sleeve 622 can serve a dual purpose.

If it is later of interest, seat 626 and fingers 462 can be drilled out. Sleeve 622 may be positioned in an annular recess in the inner wall of the tubing string such that it offers full bore access therethrough after drill out.

If there is concern that the ball retainer will restrict back flow of fluids, the tubing string can be configured such that ports 407 also allow production from the lower stages to be produced by passing out from a lower port 407*a*, through the annulus to bypass along the outer surface of the tubing string and back in through ports 407. As such, flow may avoid any flow constrictions such as balls that are trapped by the ball retainer.

A method for treating a multi-leg well is described above. In summary, with reference to FIG. 13, a multi-leg well is formed through a formation 706 and includes a main wellbore 708 and a plurality of wellbore legs 711*a* and 711*b* that extend from the main wellbore. While a dual lateral well with two wellbore legs is shown, a multi-leg well may include any number of legs.

Figure 13A:
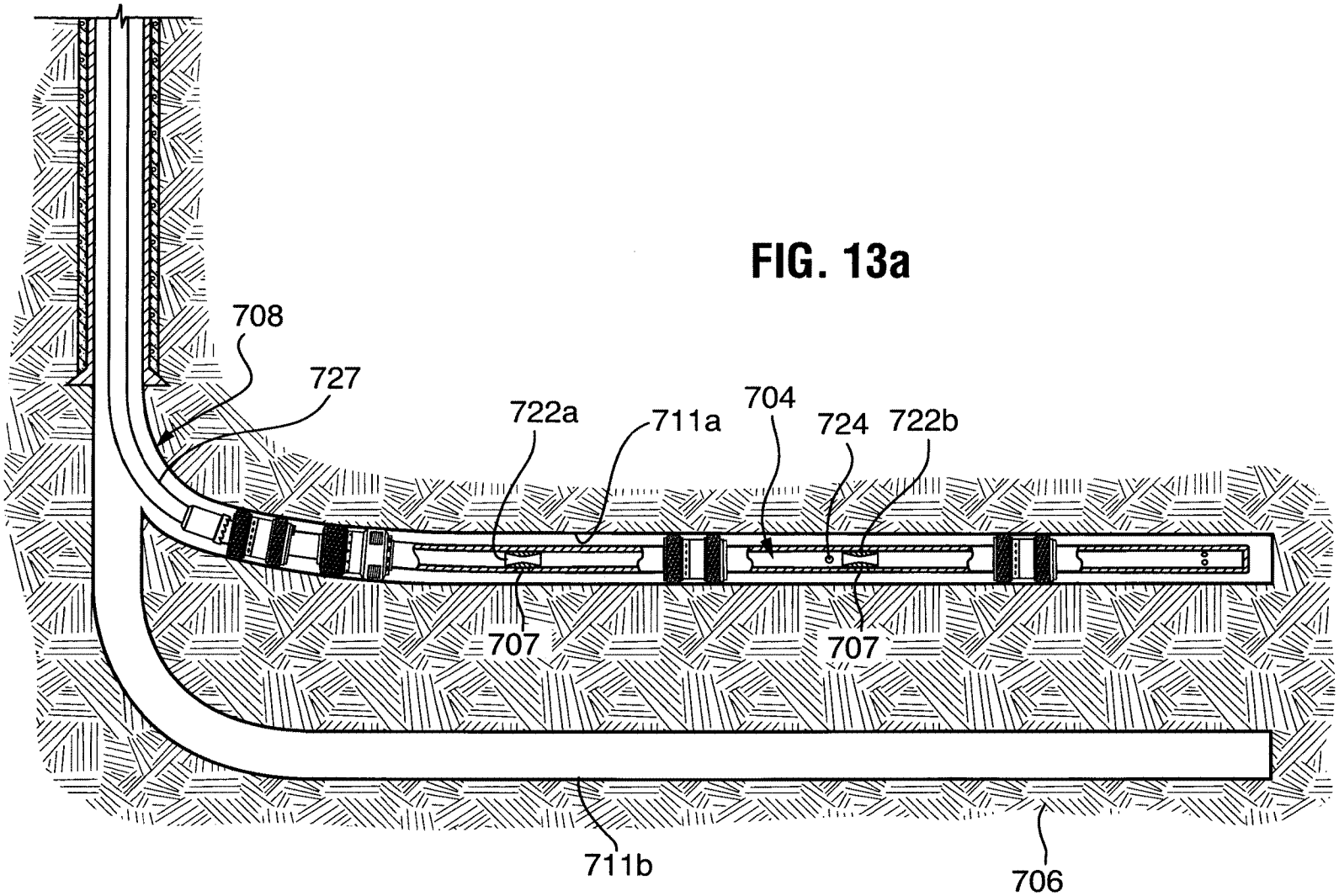
FIGS. 13*a* to 13*e* are sequential schematic views of operations in a multi-leg well.

One or more of the legs can be treated as by lining, stimulation, fracing, etc. For example, the method may include running an apparatus 704 into at least one of the legs (FIG. 13*a*). Running in may include positioning the string, setting packers to seal the annulus between the apparatus and the wellbore wall and setting slips. Packers may create isolated segments along the wellbore. The apparatus may be for wellbore treatment or production and may include one or more plug-actuated tools 722*a*, 722*b* driven by one or more plugs 724.

Figure 13B:
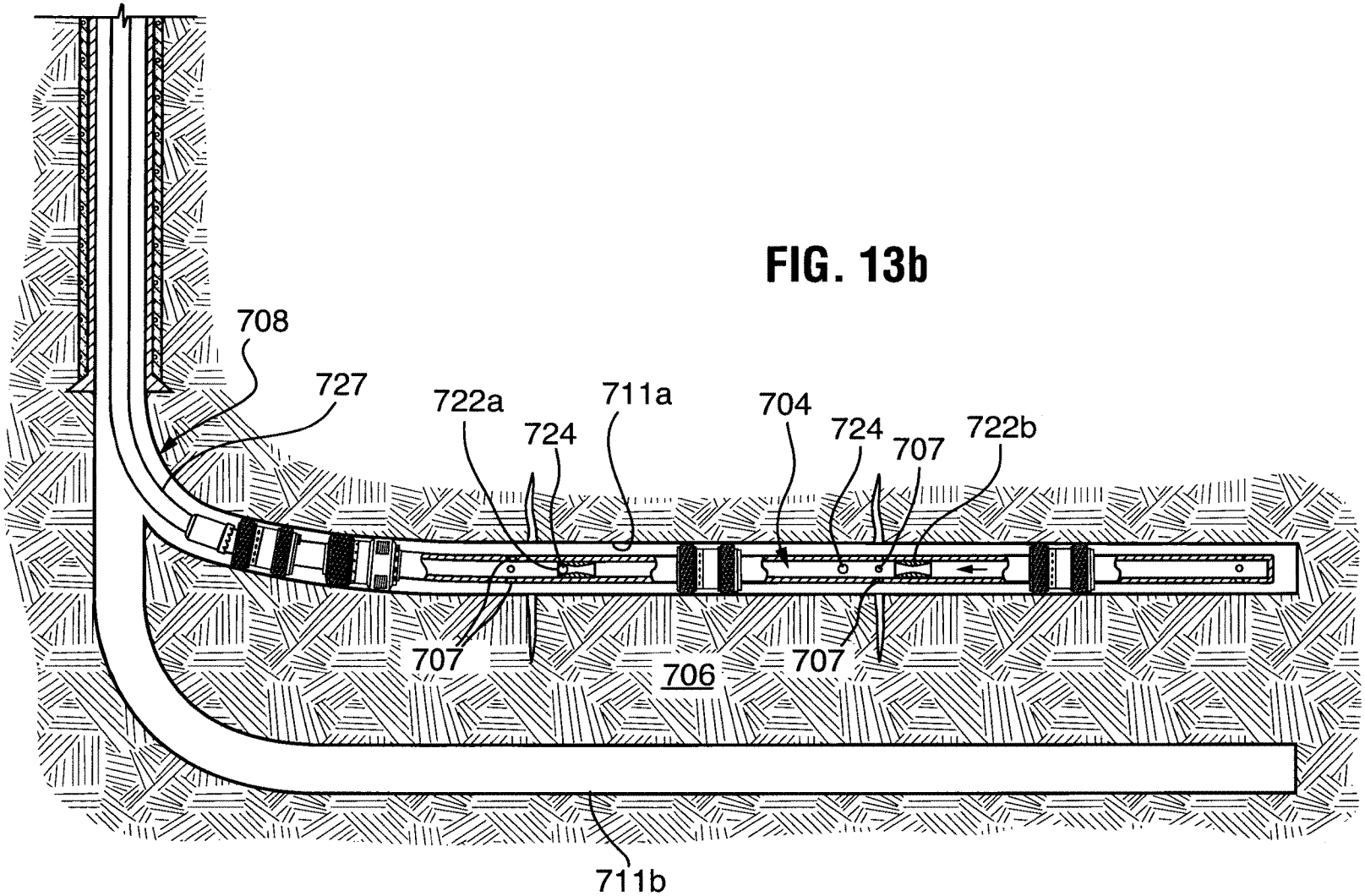

In the illustrated embodiment, for example, apparatus 704 includes a tubing string through which wellbore fluid treatment is effected and tools 722 are formed as sliding sleeves actuated by plugs 724. Plugs 724 can be conveyed into the apparatus to land in seats 726 on the sleeves and create pressure differentials to move the sleeves from a closed position to an open condition, to expose ports 707. Wellbore treatments, such as fluid injection, as for fracturing the well, may be carried out through the opened ports 707 (FIG. 13*b*). Wellbore treatments may be communicated from surface to the apparatus through a string 727 that connects onto the apparatus. String 727 includes a long bore therethrough that permits the conduction of fluid and plugs 724 from surface to the apparatus.

After the wellbore treatments, the plugs remain in the tubing string, and may unseat and may begin to move toward surface, along direction B. The plugs may be moved by fluid pressure including back flow of fluids such as treatment fluids or produced fluids. As such, a ball retainer 740 can be employed to retain the balls in the apparatus. The ball retainer prevents the first leg balls from flowing out of the apparatus, while allowing fluid flow, arrow P, upwardly past the ball retainer and out of the apparatus.

Figure 13C:
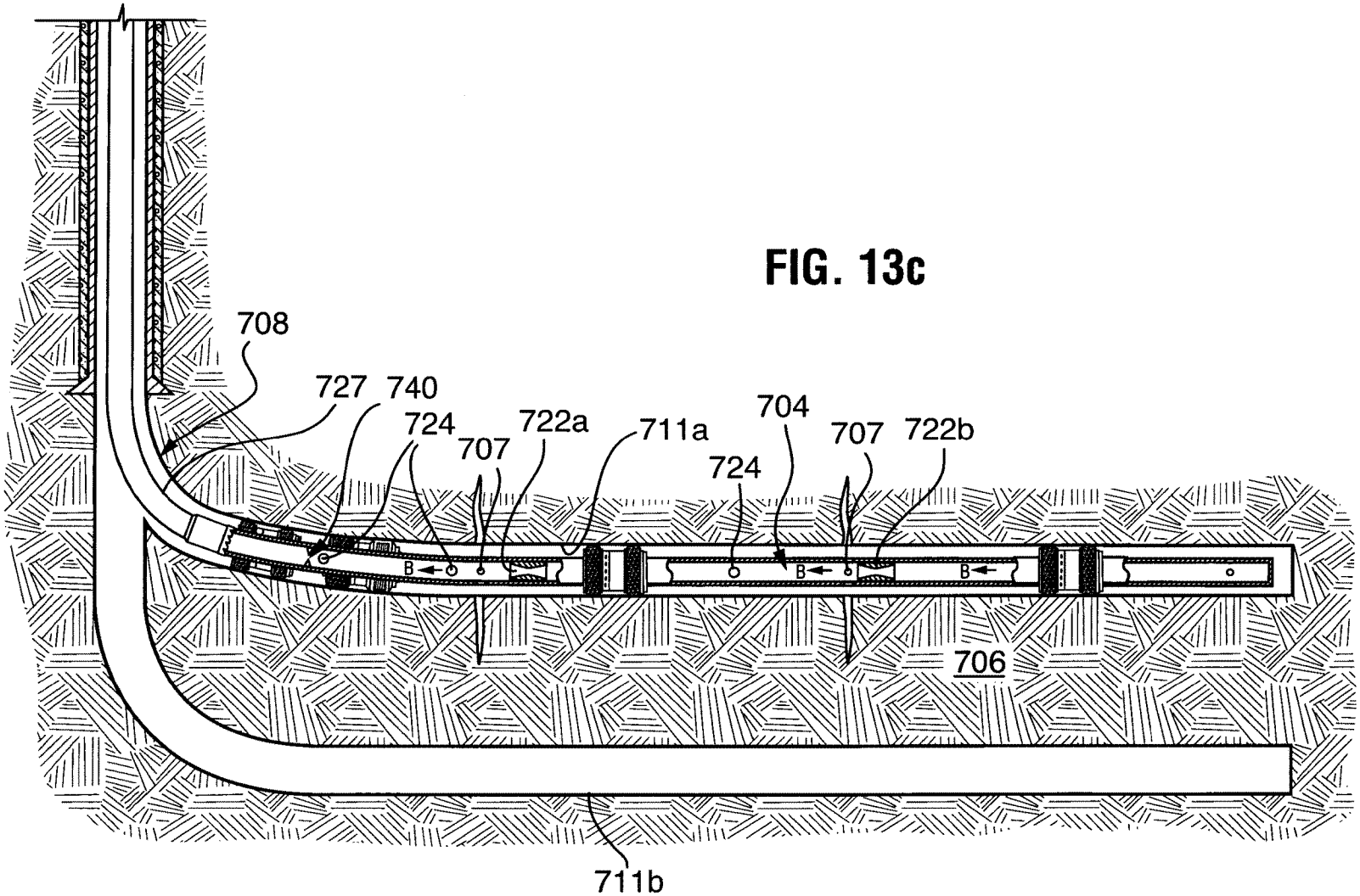
Figure 13D:
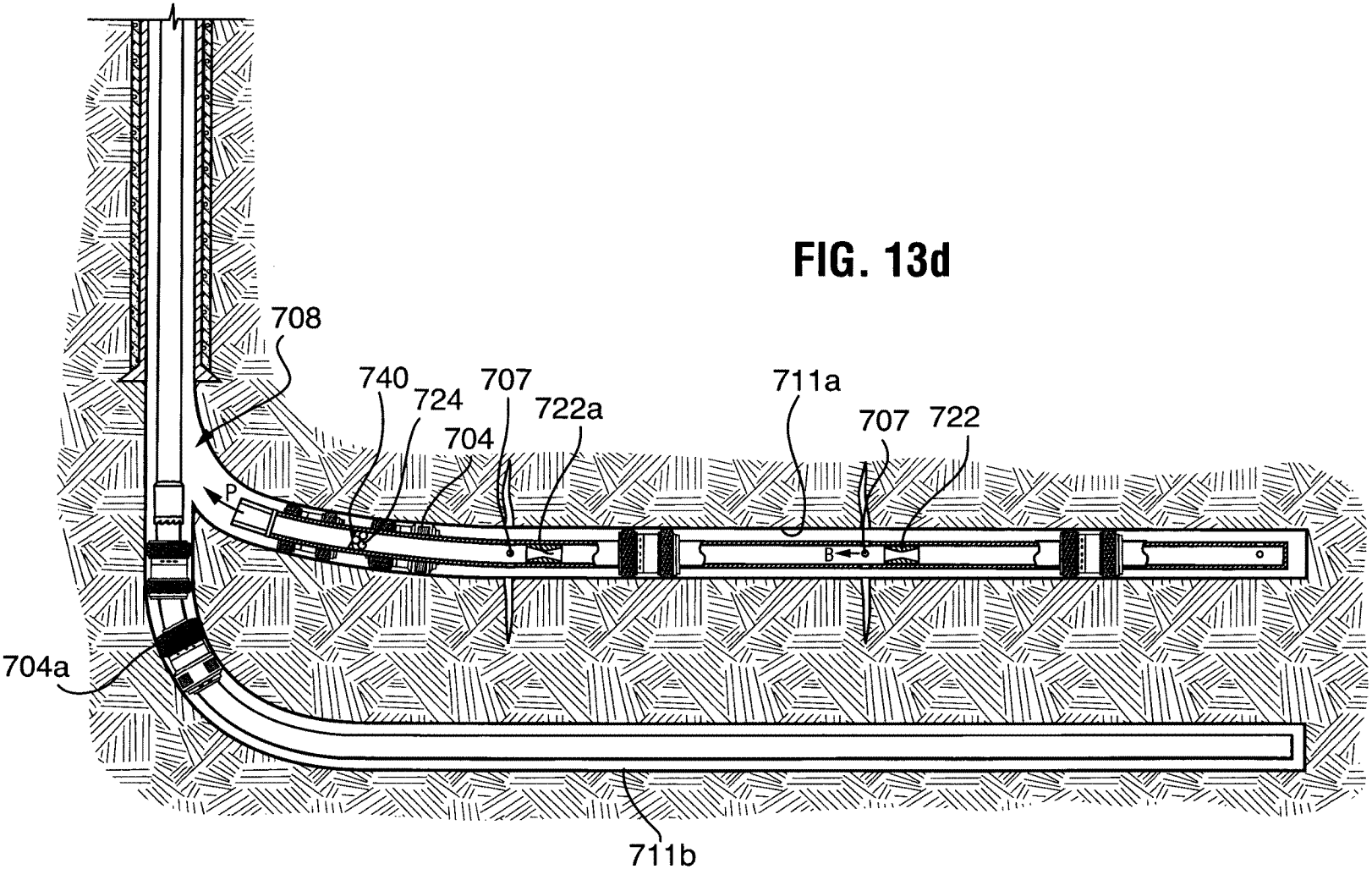

The ball retainer may have one or more features as described above with reference to any of FIGS. 2 to 12. For example, the ball retainer may already be in a blocking position in the apparatus, or may have to be set (FIG. 13*c*). In one embodiment, for example, the method includes setting the ball retainer into a plug blocking position. Setting the ball retainer, may include conveying a ball retainer to latch into the apparatus uphole of the uppermost plug-actuated site, which is tool 722*a*. Alternately, setting the ball retainer may include activating the ball retainer to move from a retracted position to protrude into the inner bore of the tubing string, as described above.

The ball retainer is generally set into a ball blocking position before the balls are able to move upwardly past the location of the ball retainer or passing out of the tubing string. In one embodiment, the ball retainer is set before any back flow is encountered in the well and possibly before any surface connection string, such as fracing string 727 is disconnected from the upper end of the apparatus.

As such plugs 724 become trapped in the apparatus 704 behind, downhole of, ball retainer 740 and cannot exit the apparatus. Fluid, however, can continue to flow from the apparatus. Fluid may flow through the trapped balls and ball retainer 740 or fluid may be bypassed about the ball retainer and/or the balls.

Operations may then be carried out in other parts of the well, including in main wellbore 708 or in other legs 711*b*. In one embodiment (FIG. 13*d*), wellbore operations may be carried out including installation of another apparatus 704*a* in another wellbore leg 711*b*. Plug-actuated operations may be conducted in the other apparatus 704*a*.

Figure 13E:
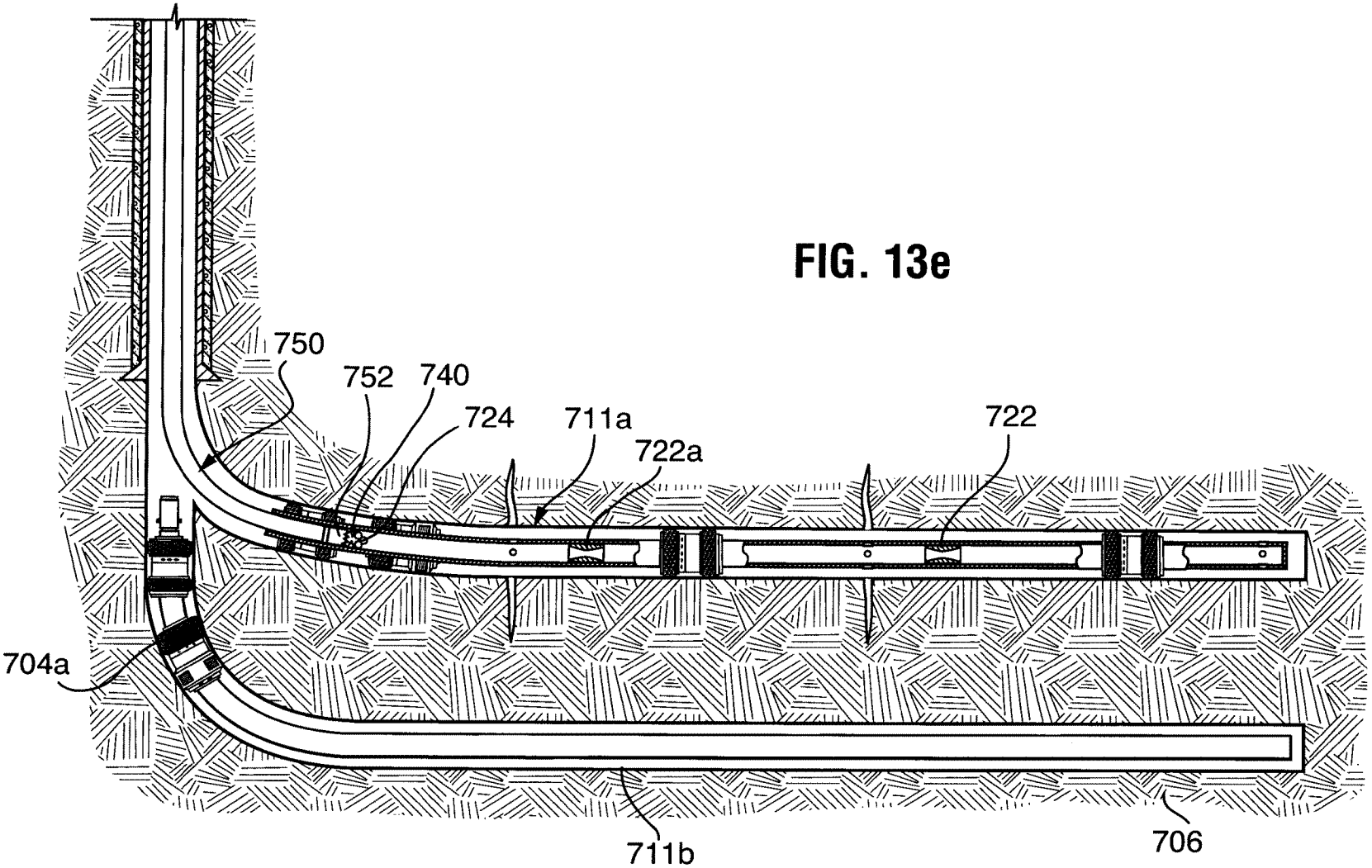

If desired, when it is appropriate to release the trapped balls and open up the apparatus, ball retainer 740 can be removed, as by drilling out the ball retainer (FIG. 13*e*). For example a drilling string 750 with a cutting head 752 may be run into the apparatus and engaged against the ball retainer to drill it out. Balls 724 can then flow out of the apparatus toward surface. Sleeve seats 726 can also be drilled out in this operation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for fluid treatment of a wellbore, the method comprising:

running a tubing string into the wellbore from surface;

conveying a plug into the tubing string to actuate a plug-actuated sleeve in the tubing string to open a port through a wall of the tubing string covered by the plug-actuated sleeve;

employing a plug retainer between an upper end of the tubing string and the plug-actuated sleeve to allow passage of the plug past the plug retainer in a direction from the upper end to the plug-actuated sleeve and to prevent the plug in the tubing string from moving past the plug retainer in a direction from the plug-actuated sleeve to the upper end while allowing fluids to flow therepast.

2. The method of claim 1 wherein the tubing string includes packers set to seal an annulus between the tubing string and the wellbore.

3. The method of claim 1 wherein conveying a plug includes pumping fluids to carry the plug into the tubing string to land in a seat on the plug-actuated sleeve, and continuing to pump fluids to create a pressure differential to move the plug-actuated sleeve.

4. The method of claim 3 wherein further comprising injecting fluid through the open port into the wellbore for wellbore fluid treatment.

5. The method of claim 1 wherein employing the plug retainer includes setting the plug retainer in a blocking position in the tubing string.

6. The method of claim 1 further comprising releasing the plug to flow out of the tubing string toward surface.

7. The method of claim 6 wherein releasing the plug includes removing the plug retainer.

8. The method of claim 7 wherein releasing the plug includes drilling out the plug retainer.

9. The method of claim 1, wherein employing the plug retainer further comprises installing the plug retainer in the tubing string prior to the running the tubing string into the wellbore.

10. The method of claim 1, wherein employing the plug retainer further comprises:

conveying the plug retainer downhole with respect to the upper end of the tubing string after the port is opened;

holding the plug retainer inside the inner bore in a retaining position.

11. The method of claim 10, wherein employing the plug retainer further comprises:

allowing the plug retainer to be ported into or at the vicinity of the retaining position using fluid flow sourced from the surface; and placing the plug retainer into the retaining position using a wireline.

12. A wellbore installation for a well including a wellbore, the wellbore installation comprising:

a tubing string including an inner bore accessible through an upper end; and, a sleeve with a valve seat, the valve seat movable in the inner bore from a port closed position to a port open position by a plug landing on the valve seat and a plug retainer positioned between the upper end and the plug-actuated sleeve to allow passage of the plug past the plug retainer in a direction from the upper end to the plug-actuated sleeve, to prevent the plug in the tubing string from moving past the plug retainer in a direction from the plug-actuated sleeve to the upper end, and to allow fluids to flow therepast.

13. The apparatus of claim 12, wherein the plug retainer comprises a body adapted to be installed on a wall of the tubing string and a gate extending inside the inner bore, adapted to enable fluid flow in one direction and disable passage of the plug in the other direction.

14. The apparatus of claim 13, wherein the gate is one of a spring, a collet finger or a flap.

15. The apparatus of claim 13, wherein the plug retainer comprises a fluid conveyed body adapted to be engaged to an engaging profile provided in the tubing string.

16. The apparatus of claim 13, wherein the body includes a plurality of fins that facilitate and stabilize the movement of the body through the fluid flow within the tubing string.

17. The apparatus of claim 12, wherein the plug retainer comprises:

a body;

a plurality of spring-biased expansion rings adapted to lock the body into an annular recess in the tubing string;

a seal for enabling conveyance of the body into the tubing string;

a screen extending inside the inner bore, adapted to enable fluid flow in one direction and disable passage of a plug in the other direction.

* * * * *